US008983346B2

(12) United States Patent
Fukamachi

(10) Patent No.: US 8,983,346 B2
(45) Date of Patent: Mar. 17, 2015

(54) DEVELOPMENT DEVICE

(75) Inventor: Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 118 days.

(21) Appl. No.: 13/597,332

(22) Filed: Aug. 29, 2012

(65) Prior Publication Data

US 2013/0051868 A1 Feb. 28, 2013

(30) Foreign Application Priority Data

Aug. 30, 2011 (JP) ..... 2011-186879

(51) Int. Cl.
*G03G 15/08* (2006.01)
*H01R 13/52* (2006.01)
*G03G 21/18* (2006.01)

(52) U.S. Cl.
CPC ..... *H01R 13/5221* (2013.01); *G03G 21/1814* (2013.01)
USPC ..... 399/284; 399/119

(58) Field of Classification Search
CPC ..... G03G 15/0896; G03G 15/0894; G03G 21/181
USPC ..... 399/119, 284
See application file for complete search history.

(56) References Cited

U.S. PATENT DOCUMENTS

| | | | | |
|---|---|---|---|---|
| 8,588,644 | B2 * | 11/2013 | Nakajima | 399/119 |
| 2007/0036581 | A1 | 2/2007 | Okabe | |
| 2008/0138108 | A1 * | 6/2008 | Okabe et al. | 399/111 |
| 2009/0180816 | A1 | 7/2009 | Sato et al. | |
| 2011/0158687 | A1 * | 6/2011 | Mori | 399/119 |
| 2011/0158688 | A1 * | 6/2011 | Mori | 399/119 |
| 2011/0158708 | A1 * | 6/2011 | Mori | 399/284 |
| 2011/0158709 | A1 * | 6/2011 | Mori | 399/284 |
| 2011/0158710 | A1 * | 6/2011 | Shiraki et al. | 399/284 |

FOREIGN PATENT DOCUMENTS

JP 2009-168993 A 7/2009

OTHER PUBLICATIONS

Mar. 4, 2014 Office Action issued in Chinese Patent Application No. 201210313930.3.

* cited by examiner

*Primary Examiner* — Ryan Walsh
(74) *Attorney, Agent, or Firm* — Banner & Witcoff, Ltd.

(57) ABSTRACT

A development device includes a first frame and a second frame. The second frame is configured to be combined with the first frame by fixing first, second and third walls of the first frame to the second frame. The first and second walls are disposed opposite to each other, and the third wall is configured to connect the first and second walls. An opening is formed by the combined first and second frames. The first frame includes first and second engageable portions, and the second frame includes third and fourth engageable portions, such that engagement of the first and second engageable portions with the third and fourth engageable portions brings the first and second frames into alignment. The first and second engageable portions are disposed between the first wall and the second wall.

11 Claims, 6 Drawing Sheets

DEVELOPMENT DEVICE

CROSS-REFERENCE TO RELATED APPLICATION(S)

This application claims priority from Japanese Patent Application No. 2011-186879 filed on Aug. 30, 2011, the disclosure of which is incorporated herein by reference in its entirety.

FIELD

Apparatuses consistent with one or more aspects of the present invention relate to a development device comprising two frames fixed together.

BACKGROUND

A development device such as a development cartridge for use in an image forming apparatus may be configured to comprise a lower frame and an upper frame wherein the lower frame includes right and left sidewalls, and bottom and rear walls which connect the right and left sidewalls. When the upper frame is welded on an upper surface of the lower frame (i.e., upper surfaces of the right and left sidewalls and the rear wall), an opening and a toner reservoir are formed therein.

In such a development device, a boss and a corresponding boss hole may be formed on an upper surface of each sidewall of the lower frame and in the upper frame, respectively, so that the boss and the boss hole are engaged with each other to place the upper and lower frames in alignment.

In order to provide sufficient areas of faying surfaces of the both frames, it may be preferable that the boss or like structures formed on the upper surface (i.e., faying surface) of the lower frame be dispensed with. Sufficient areas of faying surfaces could be made on the upper surface of the lower frame by thickening part of the sidewalls of the lower frame; however, this would disadvantageously increase the size of the development device.

There is a need to provide a developing device in which the size of the device can be reduced while ensuring that sufficient areas of the faying surfaces are provided.

SUMMARY

It is one aspect to provide a development device in which the aforementioned need is satisfied.

More specifically, according to one or more embodiments of the present invention, a development device which comprises a first frame and a second frame is provided. The first frame includes a first wall, a second wall, a third wall, a first engageable portion and a second engageable portion. The second wall is disposed opposite to the first wall. The third wall is configured to connect the first wall and the second wall. The second frame is configured to be combined with the first frame by fixing the first wall, the second wall and the third wall of the first frame to the second frame. An opening is formed by the combined first and second frames. The second frame includes a third engageable portion and a fourth engageable portion, such that engagement of the first engageable portion with the third engageable portion and engagement of the second engageable portion with the fourth engageable portion brings the first frame and the second frame into alignment. The first engageable portion and the second engageable portion are disposed between the first wall and the second wall.

BRIEF DESCRIPTION OF THE DRAWINGS

The above aspect, various configurations, their advantages and further features of the present invention will become more apparent by describing in detail illustrative, non-limiting embodiments thereof with reference to the accompanying drawings, in which.

DESCRIPTION OF EMBODIMENTS

Figure 1:
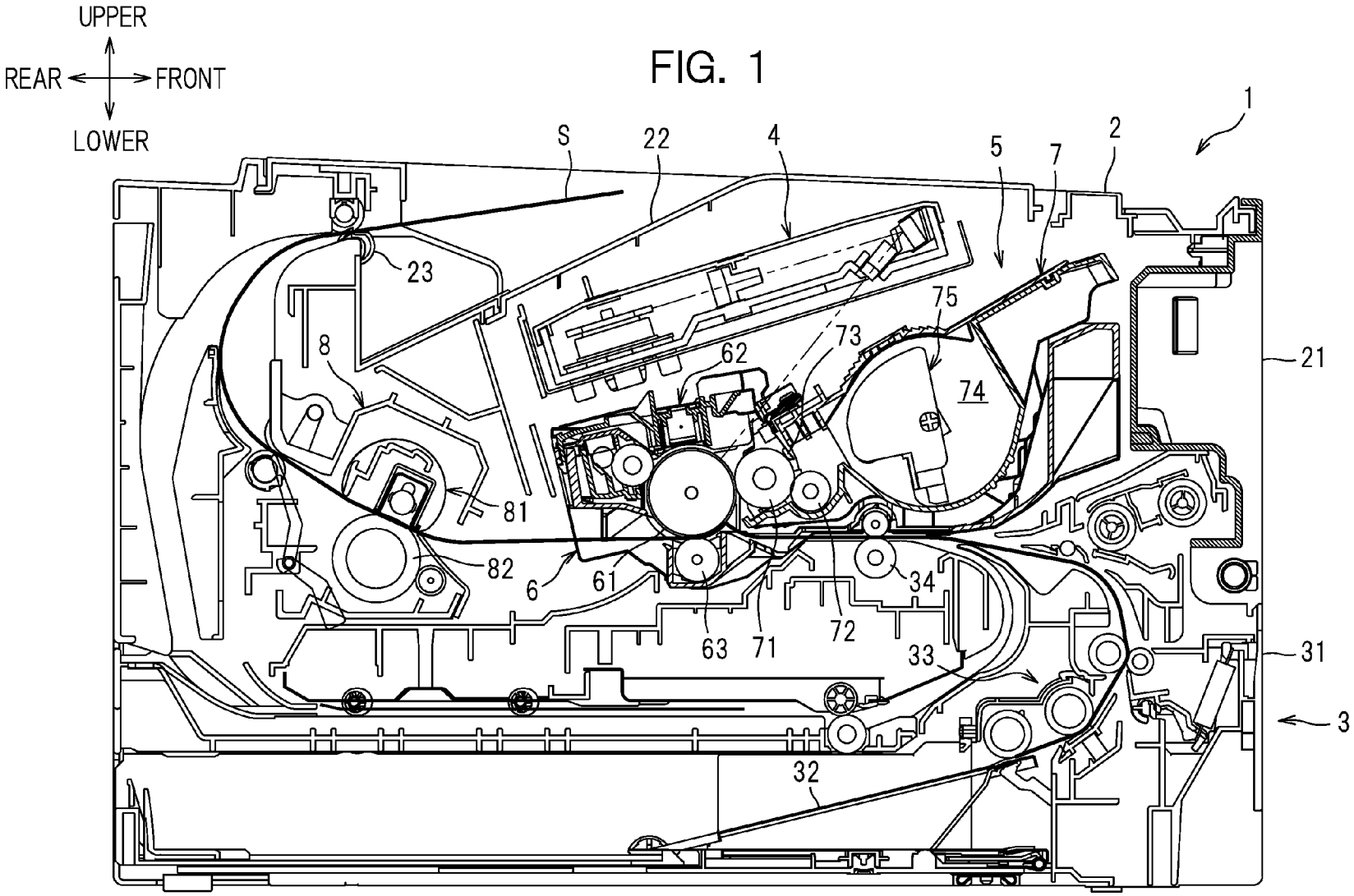
FIG. 1 is a schematic diagram of a laser printer in which a development cartridge as an example of a development device is installed.

A detailed description will be given of an illustrative embodiment of the present invention with reference to the drawings. In the following description, a general setup of a laser printer 1 (image forming apparatus) in which a development cartridge 7 as an example of a development device configured according to the present embodiment is installed will be described at the outset, and then features relating to the development cartridge 7 will be described in detail.

Hereinbelow, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction of a line extending from top to bottom of the drawing sheet corresponds to the "vertical" or "up/down (upper/lower or top/bottom)" direction of the printer.

<General Setup of Laser Printer>

As shown in FIG. 1, the laser printer 1 comprises a body casing 2, and several components housed within the body casing 2 which principally include a sheet feeder unit 3 configured to feed a sheet S (e.g., of paper), an exposure device 4, a process cartridge 5 configured to transfer a toner image (developer image) onto the sheet S, and a fixing device 8 configured to thermally fix the toner image on the sheet S.

The sheet feeder unit 3 is provided in a lower space within the body casing 2, and principally includes a sheet feed tray 31, a sheet pressure plate 32, a sheet feed mechanism 33 and a registration roller 34. Sheets S stored in the sheet feed tray 31 are pushed up by the sheet pressure plate 32, and one sheet S separated from the others is fed by the sheet feed mechanism 33 toward the process cartridge 5, and passes through the registration roller 34 in which the sheet S is aligned in registration and gets ready to be conveyed into an interface between a photoconductor drum 61 and a transfer roller 63 in a photoconductor cartridge 6.

The exposure device 4 is provided in an upper space within the body casing 2, and principally includes a laser beam emitter (not shown), a polygon mirror, lenses and reflecting mirrors (shown in part, but indication with reference characters omitted). The exposure device 4 is configured to cause a laser beam produced based upon image data by the laser beam emitter to travel along a path indicated by alternate long and short dashed lines, so that a peripheral surface of the photoconductor drum 61 is rapidly scanned and illuminated consecutively with the laser beam.

The process cartridge 5 is disposed below the exposure device 4 within the body casing 2, and configured to be installable in and removable from the body casing 2 through an opening formed when a front cover 21 provided at the body casing 2 is swung open. The process cartridge 5 includes a photoconductor cartridge 6 and a development cartridge 7.

The photoconductor cartridge 6 principally includes a photoconductor drum 61, a charger 62 and a transfer roller 63.

The development cartridge 7 is configured to be detachably attachable to the photoconductor cartridge 6, and thus is removably installable together with the photoconductor cartridge 6 (i.e., as a part of the process cartridge 5) in the body casing 2. The development cartridge 7 principally includes a development roller 71, a supply roller 72, a doctor blade 73, a toner reservoir 74 which is configured to store toner (as an example of developer) therein, and an agitator 75.

In the process cartridge 5, the peripheral surface of the photoconductor drum 61 is uniformly charged by the charger 62, and then exposed to a rapidly sweeping laser beam from the exposure device 4 so that an electrostatic latent image formulated based upon image data is formed on the photoconductor drum 61. Meanwhile, toner in the toner reservoir 74 is being agitated by the agitator 75, and is supplied first to the supply roller 72 and then from the supply roller 72 to the development roller 71. As the development roller 72 rotates, the toner goes through between the development roller 71 and the doctor blade 73 so that a thin layer of toner having a predetermined thickness is carried on the development roller 71.

The toner carried on the development roller 71 is supplied from the development roller 71 to the electrostatic latent image formed on the photoconductor drum 61. Accordingly, the electrostatic latent image is visualized and a toner image is formed on the photoconductor drum 61. Thereafter, while a sheet S is conveyed through between the photoconductor drum 61 and the transfer roller 63, the toner image on the photoconductor drum 61 is transferred onto the sheet S.

The fixing device 8 is disposed rearwardly of the process cartridge 5. The fixing device 8 principally includes a heating unit 81 and a pressure roller 82. The heating unit 81 includes a halogen heater, a fixing belt, a nip plate and other components which are shown but of which indication with reference characters is omitted. The pressure roller 82 is disposed opposite to the nip plate of the heating unit 81 and configured to be pressed against the nip plate so that the fixing belt of the heating unit 81 is nipped between the pressure roller 82 and the nip plate of the heating unit 81. In the fixing device 8, a sheet S with a toner image transferred thereon is conveyed through between the pressure roller 82 and the heated fixing belt of the heating unit 81, so that the toner image is thermally fixed on the sheet S. The sheet S with the toner image thermally fixed thereon is ejected by a sheet ejection roller 23 onto a sheet output tray 22.

<Detailed Structure of Development Cartridge>

Figure 2:
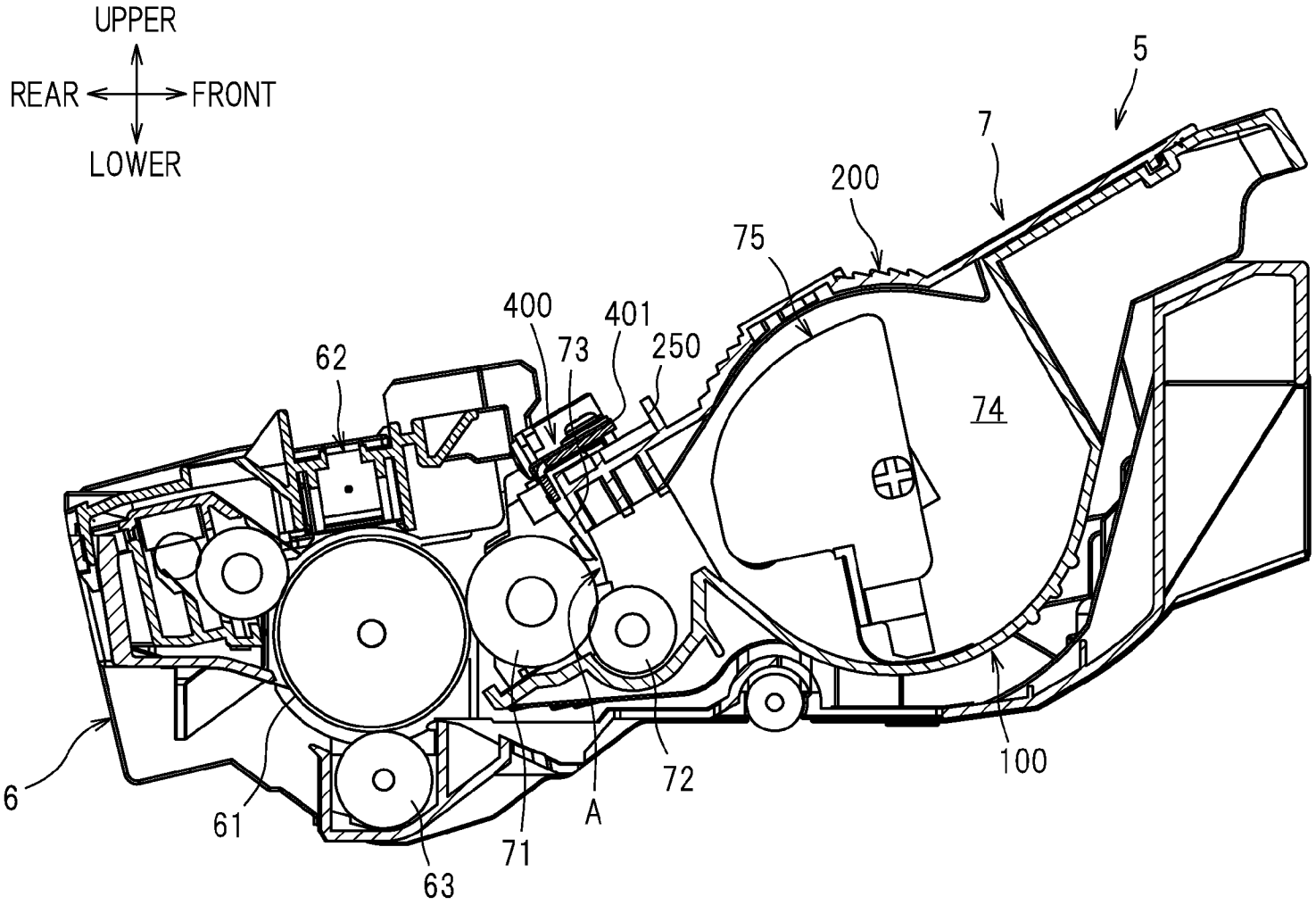
FIG. 2 is a sectional view of a process cartridge.
Figure 3:
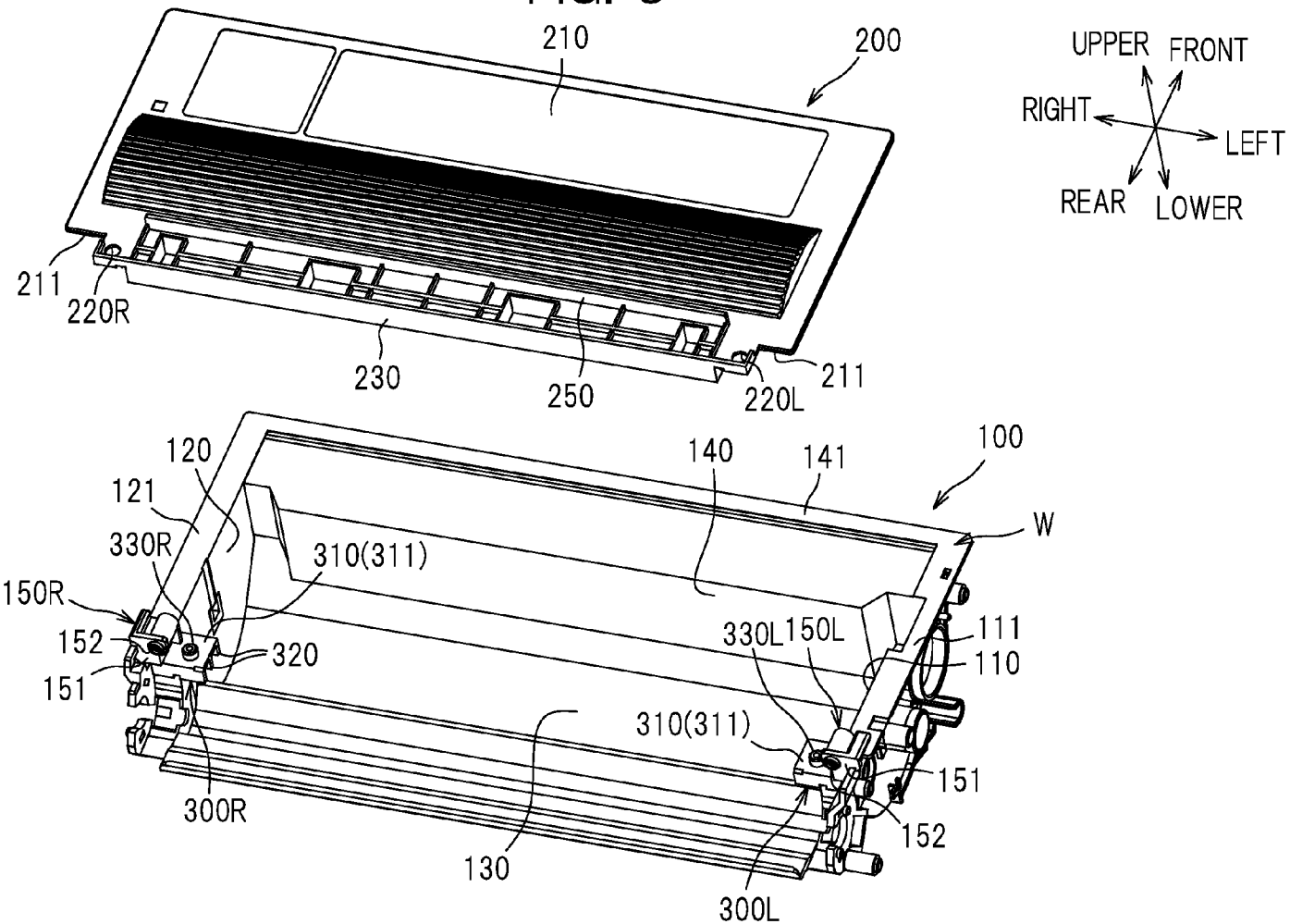
FIG. 3 is a perspective view of an upper frame and a lower frame, disassembled, of the process cartridge.

As shown in FIG. 2, the development cartridge 7 includes, in addition to the aforementioned components 71-75, a lower frame 100 as an example of a first frame, an upper frame as an example of a second frame, a left extension portion 300L as an example of a first extension portion, and a right extension portion 300R as a second extension portion (see also FIG. 3).

As shown in FIG. 3, the lower frame 100 principally includes a left sidewall 110 as an example of a first wall, a right sidewall 120 as an example of a second wall, and a bottom wall 130 and a front wall 140 as an example of a third wall.

The left sidewall 110 and the right sidewall 120 are disposed opposite to each other, facing in a leftward-and-rightward direction (the direction of an axis of rotation of the development roller 71). Lower ends of the left and right sidewalls 110, 120 are connected by the bottom wall 130, and front sides of the left and right sidewalls 110, 120 are connected by the front wall 140. Upper surfaces 111, 121, 141 of the left sidewall 110, the right sidewall 120 and the front wall 140 are continuously configured as a single flat surface shaped generally like a letter U as viewed in plan view, so as to provide a weld surface W as an example of a faying surface to be fixed to a faying surface of the upper frame 200 which will be described later in detail.

The left sidewall 110 includes a left mount portion 150L as an example of a first mount portion, and the right sidewall 120 includes a right mount portion 150R as an example of a second mount portion. The left and right mount portions 150L, 150R are portions to which the doctor blade 73 (blade assembly 400) is fixed. The left mount portion 150L is formed to protrude upward from a rear end portion of the upper surface 111 (weld surface W) of the left sidewall 110, and the right mount portion 150R is formed to protrude upward from a rear end portion of the upper surface 121 (weld surface W) of the right sidewall 120.

Figure 4:
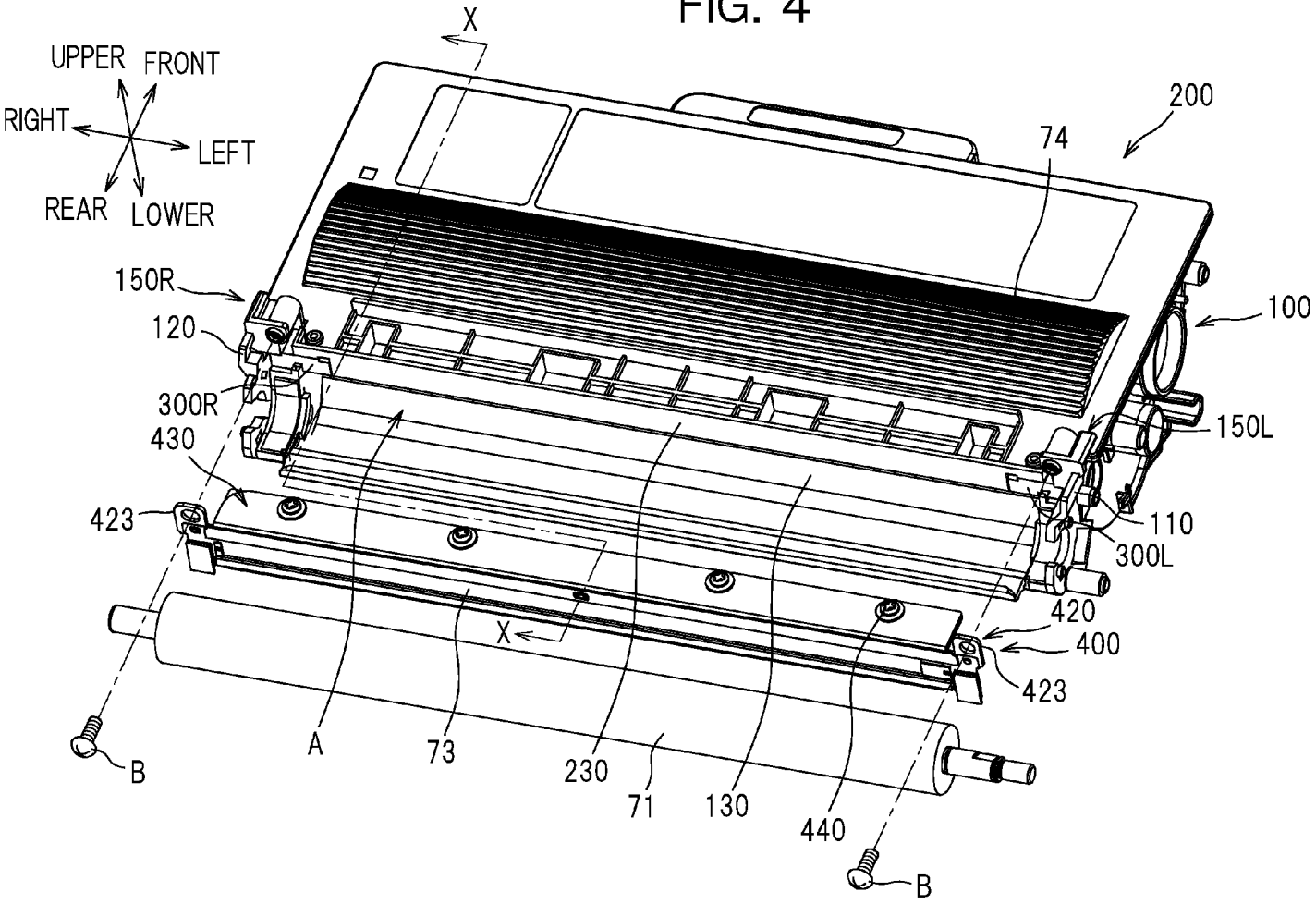
FIG. 4 is an exploded perspective view of the development cartridge.

Each of the left mount portion 150L and the right mount portion 150R has a screw hole 152 provided in a rear surface 151 (surface facing to a side on which the development roller 71 is to be provided) thereof, so that the blade assembly 400 will be fixed to the left and right mount portions 150L, 150R by screws B, as shown in FIG. 4.

Figure 5:
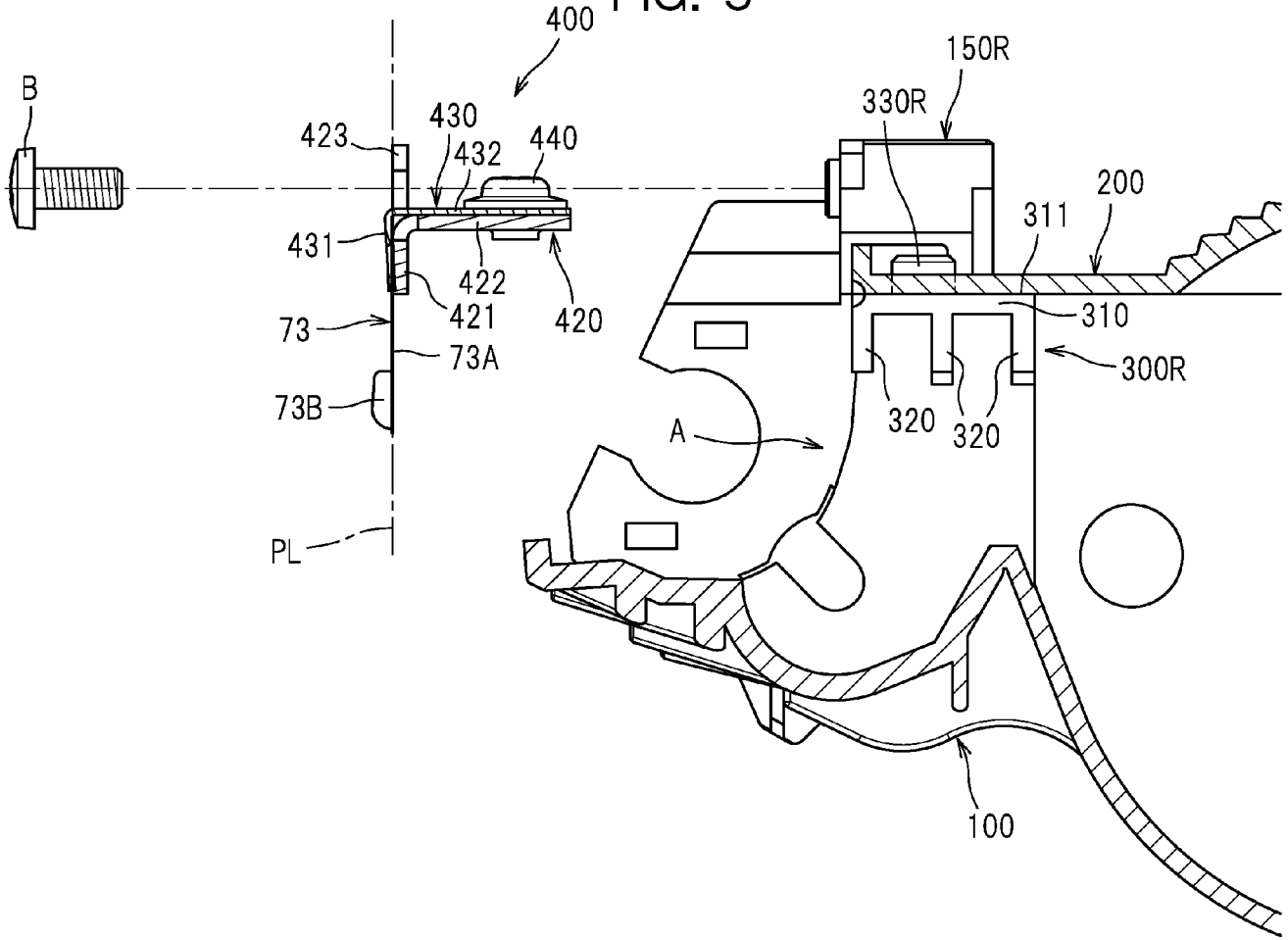
FIG. 5 is a sectional view taken along line X-X of FIG. 4.

As shown in FIG. 5, the blade assembly 400 principally includes a doctor blade 73, a blade holder 420, and a blade reinforcing plate 430.

The doctor blade 73 includes a plate member 73A made of a metal plate shaped substantially like a rectangle, and a pressing member 73B made of rubber. The pressing member 73B is provided on a rear side of a lower-end portion of the plate member 73A, and configured to bulge rearwardly (toward the development roller 71). The pressing member 73B of the doctor blade 73 in operation is brought into contact with the development roller 71 being caused to rotate, and the thickness of toner on the peripheral surface of the development roller 71 is regulated while the peripheral surface of the rotating development roller is sliding on the doctor blade 73.

The blade holder 420 is formed by bending a metal plate substantially into the shape of a letter L as seen in side view, and principally includes a holding portion 421 extending in the upward-and-downward direction of FIG. 5, a connecting portion 422 extending in the leftward-and-rightward direction of FIG. 5, and a pair of attachment portions 423 extending upward from the left and right ends of the holding portion 421 (see also FIG. 4). The blade reinforcing member 430 is formed by bending a metal plate substantially into the shape of a letter L as seen in side view, and principally includes a holding portion 431 extending in the upward-and-downward direction of FIG. 5, and a connecting portion 432 extending in the leftward-and-rightward direction of FIG. 5.

The blade assembly 400 is an assembly made by holding an upper-end portion of the doctor blade 73 (the plate member 73A thereof) by the holding portions 421, 431 and fastening the connecting portions 422, 432 together by screws 440. The blade assembly 400 is fixed to the lower frame 100 by screws B applied to the left and right attachment portions 423 of the blade holder 420 positioned in alignment with the left and right mount portions 150L, 150R, respectively, of the lower frame 100.

In the present embodiment, the doctor blade 43 can be fixed on a surface substantially parallel to a tangent plane which contains a line of contact of the doctor blade with the peripheral surface of the development roller 71, that is, on a plane PL substantially parallel to the direction of extension of the plate member 73A on which the pressing member 73B is provided.

An alternative arrangement of the doctor blade is known in which a plate member is shaped, by bending, substantially like a letter L in side view such that the plate member includes a first portion having a surface to which a pressing member is attached and a second portion having a surface at which the doctor blade is fixed to a frame, the second portion extending in a direction different from a direction of extension of the first portion. However, such a bent-plate configuration of the doctor plate would, in some instances, lead to undesirable variations in the contact pressure of the doctor blade against the development roller due to tolerances involved in the bending process during manufacturing. In contrast, in the present embodiment, the plate member 73A is not bent, and thus such variations in the contact pressure as derived from the tolerances involved in the bending process are eliminated.

In the present embodiment, each of the left and right mount portions 150L, 150R has a protruding portion that protrudes upward from the weld surface W; therefore, a distance between the lower-end portion of the doctor blade 73 (plate member 73A) and each attachment portion 423 can be increased, so that deformation of the doctor blade 73, particularly of a portion thereof at or around the lower-end portion of the plate member 73A, which would be caused by tightening the screws B can be suppressed. Accordingly, undesirable variations in the contact pressure of the doctor blade 73 against the peripheral surface of the development roller 71 can be reduced.

As shown in FIG. 3, the left extension portion 300L is disposed to extend from a rear end of a surface, facing inward in the leftward-and-rightward direction (i.e., right side; inner side), of the left sidewall 110 inwardly toward the right sidewall 120, and the right extension portion 300R is disposed to extend from a rear end of a surface, facing inward in the leftward-and-rightward direction (i.e., left side; inner side), of the right sidewall 120 inwardly toward the left sidewall 110. To be more specific, the left extension portion 300L is disposed adjacent to, and inward (in the leftward-and-rightward direction) of, the left mount portion 150L, and the right extension portion 300R is disposed adjacent to, and inward (in the leftward-and-rightward direction) of, the right mount portion 150R.

Each of the left extension portion 300L and the right extension portion 300R principally includes an upper wall 310 and a plurality of first ribs 320.

An upper surface 311 of the upper wall 310 is contiguous and flush with upper surfaces 111, 121 (weld surfaces W) of the left sidewall 110 and the right sidewall 120.

A left boss 330L, as an example of a first engageable portion configured as a projection, which is shaped generally like a circular cylinder protruding upward is provided on the upper surface 311 of the upper wall 310 of the left extension portion 300L. A right boss 330R, as an example of a second engageable portion configured as a projection, which is shaped generally like a circular cylinder protruding upward is provided on the upper surface 311 of the upper wall 310 of the right extension portion 300R.

In other words, the left boss 330L and the right boss 330R are disposed between the left sidewall 110 and the right sidewall 120, and between the left mount portion 150L and the right mount portion 150R (i.e., disposed inward, in the leftward-and-rightward direction, of the left and right mount portions 150L, 150R).

As shown in FIG. 5, the first ribs 320 are configured to protrude from the undersurface of the upper wall 310 downward and to extend in the leftward-and-rightward direction. To be more specific, each of the first ribs 320 is disposed to extend downward when the development cartridge 7 is operational. The term "operational" used herein refers to the state in which the device is able to function or be used. In this embodiment, it is understood that the development cartridge 7 is operational when the development cartridge 7 is installed in the body casing 2 of the laser printer 1 (see FIG. 1).

The first ribs 320 serves to reinforce the extension portions 300L, 300R (upper walls 310 thereof). Also, the arrangement and configuration of the first ribs 320 as described above serve to reduce the possibility that developer fed into a space under each extension portion 300L, 300R would get retained or accumulated between the ribs 320.

As shown in FIG. 3, the upper frame 200 comprises a main body 210 shaped substantially like a plate, and several portions provided in or on the main body 210 which include a left boss hole 220L as an example of a third engageable portion, a right boss hole 220R as an example of a fourth engageable portion, a beam-like portion 230, a weld rib 240 (see FIG. 6), and a second rib 250.

The upper frame 200 is configured to be combined with the lower frame 100 by welding the left sidewall 110, the right sidewall 120 and the front wall 140 of the lower frame 100 to the lower frame 100, and an opening A through which toner is to be supplied to the development roller 71, and a toner reservoir 74 are formed by the combined lower and upper frames 100, 200, as shown in FIG. 4. The development roller 71 is disposed opposite to the opening A formed by the lower frame 100 and the upper frame 200 (see FIG. 4).

Referring again to FIG. 3, the main body 210 has cutaways 211 formed by cutting off left and right corners at a rear side thereof. The cutaways 211 are so shaped as to allow the left mount portion 150L and the right mount portion 150R to be fitted in the left and right cutaways 211, respectively, when the upper frame 200 is combined with the lower frame 100 (see FIG. 4).

The left boss hole 220L is a through hole engageable with the left boss 330L provided in the lower frame 100, and is disposed on the right side (inward, in the leftward-and-rightward direction) of the left cutaway 211. The right boss hole 220R is a through hole engageable with the right boss 330R provided in the lower frame 100, and is disposed on the left side (inwardly, in the leftward-and-rightward direction) of the right cutaway 211.

The beam-like portion 230 is a portion protruding downward from the rear side of the main body 210 between the left boss hole 220L and the right boss hole 220R (inward thereof in the leftward-and-rightward direction). As shown in FIG. 4, the beam-like portion 230 has left and right sides which come in contact with inner surfaces, in the leftward-and-rightward direction, of the extension portions 300L, 300R, respectively, when the upper frame 200 is combined with the lower frame 100, so that the opening A is formed by the beam-like portion 230, the extension portions 300L, 300R, the left sidewall 110, the right sidewall 120 and the bottom wall 130.

Figure 6:
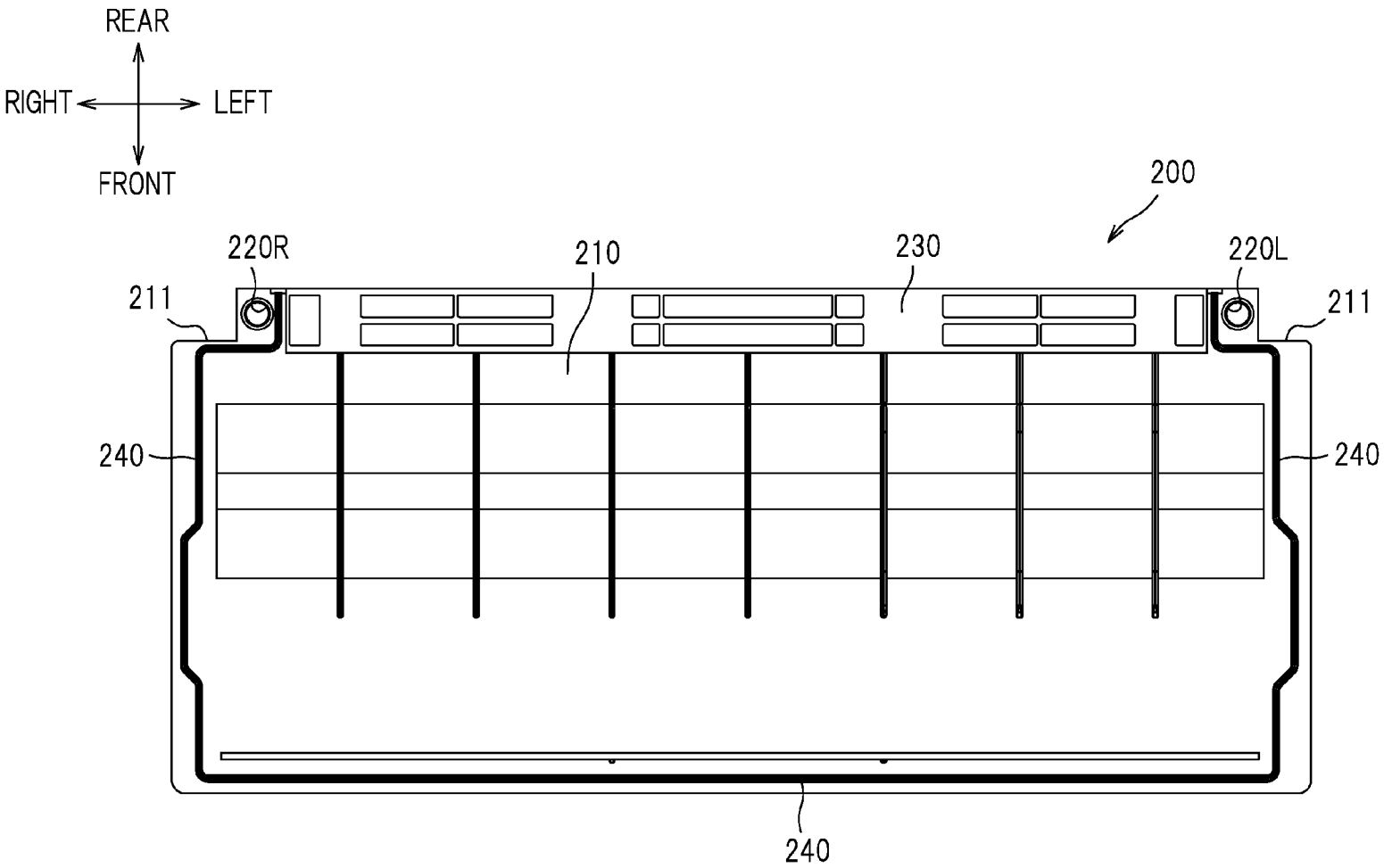
FIG. 6 is a view of the upper frame as seen from its underside.

As shown in FIG. 6, the weld rib 240 is formed on the underside of the upper frame 200, and extends on a rear side of the main body 210 from a spot located between the left boss hole 220L and the beam-like portion 230, running along the edges (the left side, the front side and the right side) of the main body 210, to a spot located between the right boss hole 220R and the beam-like portion 230. The weld rib 240 provides a surface to be welded to the weld surface W of the lower frame 100.

As shown in FIG. 3, the second rib 250 is formed on the top side of the main body 210, protruding upward, extending along the rear side of the main body 210 in the leftward-and-rightward direction. In other words, the second rib 250 extends in the leftward-and-rightward direction along one end 401 of the doctor blade 73 (more precisely, of the blade assembly 400) opposite to another end of the blade assembly 400 which is disposed to come in contact with the development roller 71 (i.e., the lower end of the doctor blade 73).

The second rib 250 serves to reinforce the upper frame 200. Also, the arrangement and configuration of the second rib 250 as described above serve to prevent a user from inadvertently touching the end 401 of the blade assembly 400.

A brief description will now be given of a method of manufacturing a development cartridge 7 as described above.

First of all, the agitator 75 (see FIG. 2) is mounted in the lower frame 100. Next, as shown in FIG. 3, the left boss hole 220L of the upper frame 200 is fitted on the left boss 330L of the lower frame 100, and the right boss hole 220R of the upper frame 200 is fitted on the right boss 330R of the upper frame 200, so that the upper frame 200 is aligned and combined with the lower frame 100, as shown in FIG. 4.

Thereafter, the weld surface W of the lower frame 100 and the weld rib 240 of the upper frame 200 are welded to each other, for example, using a known ultrasonic welding machine, so that the lower frame 100 and the upper frame 200 are fixed together. Subsequently, the supply roller 72 (not shown in FIG. 4), the doctor blade 73 (the blade assembly 400), the development roller 71 and other components are mounted, and consequently, assembly of the development cartridge 7 is completed.

According to the present embodiment described above, the following advantageous effects can be achieved.

Since the left boss 330L and the right boss 330R of the lower frame 100 are disposed between the left sidewall 110 and the right sidewall 120 in the present embodiment, the development cartridge 7 can be designed to be compact in size and light in weight, in comparison with an alternative configuration in which the left sidewall 110 and the right sidewall 120 are designed to be thicker to provide positioning bosses on their upper surfaces (weld surface W), or such positioning bosses are disposed outside the left sidewall 110 and the right sidewall 120. Furthermore, since the positioning bosses are not disposed on the weld surface W in this embodiment, a sufficient area can be provided for the weld surface W without making the left sidewall 110 and the right sidewall 120 thicker.

Moreover, since the left boss 330L is provided at the left extension portion 300L extending from the left sidewall 110 toward the right sidewall 120, and the right boss 330R is provided at the right extension portion 300R extending from the right sidewall 120 toward the left sidewall 110 in the present embodiment, the so-called "inward tilt" of the left sidewall 110 and the right sidewall 120 can be corrected by the upper frame 200 when the upper frame 200 is combined with, and fixed to, the lower frame 100. As a result, distortions which would take place in the lower frame are corrected, and thus the dimensional accuracy of the frames of the development cartridge 7 can be improved.

Furthermore, since the left boss 330L is disposed inward of the left mount portion 150L and the right boss 330R is disposed inward of the right mount portion 150R in the present embodiment, the development cartridge 7 can be miniaturized particularly in the frontward-and-rearward direction, in comparison with an alternative configuration in which, the left boss 330L and the left mount portion 150L, as well as the right boss 330R and the right mount portion 150R, are arranged in the frontward-and-rearward direction.

Since the bosses 330L, 330R are disposed between the protruding portions of the left mount portion 150L and the right mount portion 150R which protrude from the weld surface W in the present embodiment, the inward tilt of the left sidewall 110 and the right sidewall 120 due to shrinkage in the molding process during manufacturing can be suppressed because the upper frame 200 is disposed between the left and right mount portions 150L, 150R when the lower frame 100 and the upper frame 200 are combined and fixed together.

In the present embodiment, the blade assembly 400 can be mounted and fixed, correctly into place, to the left and right mount portions 150L, 150R with increased ease, so that the mounting of the blade assembly 400 can be performed easily. Furthermore, the suppression of the inward tilt of the left sidewall 110 and the right sidewall 120, and associated correction of distortion of the development cartridge 7, make it possible to achieve improved positioning accuracy of the blade assembly 400 and the frames.

Although an illustrative embodiment of the present invention has been described above, the present invention is not limited to the above-described embodiment. Various modifications and changes may be made to the specific structures and arrangement without departing from the scope of the present invention.

In the above-described embodiment, the left boss 330L (first engageable portion) is disposed inward of the left mount portion 150L (first mount portion), and the right boss 330R (second engageable portion) is disposed inward of the right mount portion 150R (second mount portion), but the present invention is not limited to this specific configuration. For example, the engageable portions (the extension portions 300L, 300R, as in FIG. 3, on which the bosses 330L, 330R are formed) may be disposed approximately at midpoints, in the frontward-and-rearward direction, of the left and right sidewalls 110, 120.

In the above-described embodiment, the left and right bosses 330L, 330R (first and second engageable portions) are disposed at the extension portions 300L, 300R, respectively, but the present invention is not limited to this specific configuration. For example, columnar portions protruding upward from the bottom wall 130 of FIG. 3 may be provided and the engageable portions may be provided at upper end portions of the protruding columnar portions.

In the present embodiment, the first engageable portion and the second engageable portion are configured as projections (the left boss 330L and the right boss 330R), and the third engageable portion and the fourth engageable portion are configured as holes (the left boss hole 220L and the right boss hole 220R), but the present invention is not limited to this specific configuration. For example, alternative equivalent configurations may include: (1) the first engageable portion and the second engageable portion are configured as holes, whereas the third engageable portion and the fourth engageable portion are configured as projections; (2) the first engageable portion and the fourth engageable portion are configured as projections, whereas the second engageable portion and the third engageable portion are configured as holes; and (3) the first engageable portion and the fourth engageable portion are configured as holes, whereas the second engageable portion and the third engageable portion are configured as projections.

The left and right bosses 330L, 330R in the illustrative embodiment shown in FIG. 3 may have diameters different from each other, and the left and right boss holes 220L, 220R which are shaped and dimensioned so as to be engageable with the left and right bosses 330L, 330R, respectively, may also have diameters different from each other, accordingly. To be specific, in one example, the left boss 330L may have larger diameter than the right boss 330R. In this configuration, the left boss hole 220L may have larger diameter than the right boss hole 220R so that the left boss 330L and right boss 330R can fit the left boss hole 220L and the right boss hole 220R, respectively. In another example, the right boss 330R may have larger diameter than the left boss 330L. In this configuration, the right boss hole 220R may have larger diameter than the left boss hole 220L so that the right boss 330R and left boss 330L can fit the right boss hole 220R and the left boss hole 220L, respectively.

In the above-described embodiment, the lower frame 100 (the first frame) and the upper frame 200 (the second frame) are fixed by welding by way of example, but the method of fixing the first frame and the second frame to each other, which is practically consistent with the present invention is not limited to this illustrated method. For example, the first frame and the second frame may be fixed by an adhesive.

In the present embodiment, the doctor blade 73 is fixed to the lower frame 100 at the attachment portions 423 aligned with the plane PL extending substantially in the upward-and-downward direction that is the plane with which the plate member 73 is aligned, but the present invention is not limited to this specific configuration. For example, the doctor blade 73 (blade assembly 400) as shown in FIG. 5 may be fixed to at least one of the upper frame 200 and the lower frame 100 on the plane with which the connecting portions 422, 432 are aligned.

The first ribs 320 of the present embodiment are illustrated by way of example, and the present invention is not limited to the specific illustrative configuration of the first ribs 320. In other words, the shape and the number of the first rib(s) consistent with the present invention may be selected arbitrarily without limitation as long as developer will not be retained or accumulated under the extension portion. For example, the first ribs 320 of FIG. 5 may be modified into an alternative configuration such that the total two first ribs 320 are provided at left and right ends (in FIG. 5) of the upper wall 310 or that only one first rib 320 is provided at the center in the leftward-and-rightward direction (in FIG. 5) of the upper wall 310.

In the above-described embodiment, the development cartridge 7 is illustrated as an example of a development device, but the present invention is not limited to this specific configuration. For example, a process cartridge in which a photoconductor cartridge 6 and a development cartridge 7 as in the above-described embodiment are provided inseparably in an integrated unit may be configured as a development device in accordance with the present invention.

In the above-described embodiment, the present invention is applied to a development device for use in the laser printer 1 for forming a monochrome image, but the present invention is not limited thereto; for example, a color printer for forming a multicolor image may be configured in accordance with one or more of the embodiments of the present invention. Also, any other image forming apparatus such as a photocopier, a multifunction peripheral and the like which includes a document scanning device (e.g., flat bed scanner) may be configured in accordance with one or more of the embodiments of the present invention.

What is claimed is:

1. A development device comprising:

a development roller configured to rotate about an axis, the development roller being rotatably supported in the development device;

a first frame including:

a first wall;

a second wall, the second wall being opposed to the first wall along a direction parallel to the axis;

a first extension portion protruding from the first wall toward the second wall;

a second extension portion protruding from the second wall toward the first wall;

a first engageable portion being provided at a protruding end of the first extension portion; and a second engageable portion being provided at a protruding end of the second extension portion; and a second frame including:

a third engageable portion configured to engage with the first engageable portion; and a fourth engageable portion configured to engage with the second engageable portion.

2. The development device according to claim 1, further comprising:

a doctor blade configured to regulate a thickness of developer on the development roller, the doctor blade extending along the direction parallel to the axis, wherein the first wall includes a first mount portion being fixed to the doctor blade, wherein the second wall includes a second mount portion being fixed to the doctor blade, and wherein each of the first engageable portion and the second engageable portion is disposed between the first mount portion and the second mount portion along the direction parallel to the axis.

3. The development device according to claim 2, wherein the first mount portion comprises a first surface, the first surface extending along the direction parallel to the axis, and the first surface being fixed to the doctor blade; and wherein the second mount portion comprises a second surface, the second surface extending along the direction parallel to the axis, and the second surface being fixed to the doctor blade.

4. The development device according to claim 1, wherein each of the first extension portion and the second extension portion includes a first rib which is disposed to extend downward.

5. The development device according to claim 1, wherein the second frame includes a second rib extending along the development roller.

6. A development device comprising:

a development roller configured to rotate about an axis, the development roller being rotatably supported in the development device;

a doctor blade configured to regulate a thickness of developer on the development roller;

a first frame including:

a first wall including a first mount portion, the first mount portion being fixed to the doctor blade;

a second wall being opposed to the first wall along a direction parallel to the axis, the second wall including a second mount portion, the second mount portion being fixed to the doctor blade;

a first engageable portion protruding from the first wall toward the second wall; and a second engageable portion protruding from the second wall toward the first wall; and a second frame including:

a third engageable portion configured to engage with the first engageable portion; and a fourth engageable portion configured to engage with the second engageable portion, wherein each of the first engageable portion and the second engageable portion is disposed between the first mount portion and the second mount portion along the direction parallel to the axis.

7. The development device according to claim 6, further comprising:

a first extension portion extending from the first wall toward the second wall; and a second extension portion extending from the second wall toward the first wall, wherein the first engageable portion is provided at the first extension portion, and wherein the second engageable portion is provided at the second extension portion.

8. The development device according to claim 7, wherein each of the first extension portion and the second extension portion includes a first rib which is disposed to extend downward.

9. The development device according to claim 6, wherein the second frame further includes a second rib extending along the development roller.

10. The development device according to claim 6, wherein the doctor blade extends along the direction parallel to the axis.

11. The development device according to claim 10, wherein the first mount portion comprises a first surface, the first surface extending along the direction parallel to the axis, and the first surface being fixed to the doctor blade; and wherein the second portion comprises a second surface, the second surface extending along the direction parallel to the axis, and the second surface being fixed to the doctor blade.

* * * * *